US011642581B1

(12) United States Patent
Gucu

(10) Patent No.: US 11,642,581 B1
(45) Date of Patent: May 9, 2023

(54) WATER GAME APPARATUS

(71) Applicant: Matthew Gucu, Las Vegas, NV (US)

(72) Inventor: Matthew Gucu, Las Vegas, NV (US)

( * ) Notice: Subject to any disclaimer, the term of this patent is extended or adjusted under 35 U.S.C. 154(b) by 0 days.

(21) Appl. No.: 17/728,847

(22) Filed: Apr. 25, 2022

Related U.S. Application Data

(60) Provisional application No. 63/296,108, filed on Jan. 3, 2022.

(51) Int. Cl.
*A63B 67/00* (2006.01)
*B63B 32/00* (2020.01)

(52) U.S. Cl.
CPC ..... *A63B 67/007* (2013.01); *A63B 2225/605* (2013.01); *B63B 32/00* (2020.02)

(58) Field of Classification Search
CPC ..... B63B 32/00; B63B 32/20; B63B 32/22; B63B 32/40; B63B 32/50; B63B 32/51; B63B 32/53; B63B 32/57; B63C 9/00; B63C 9/04; A61G 1/00; A63B 2225/60; A63B 2225/605; A63B 67/007
USPC ..... 441/35, 47
See application file for complete search history.

(56) References Cited

U.S. PATENT DOCUMENTS 179,913 A * 7/1876 Hager ..... B65D 9/10 217/122
3,620,529 A * 11/1971 Newman ..... A63B 67/007 472/129
3,703,011 A * 11/1972 Goggi ..... A63B 67/007 463/47.1
3,779,156 A * 12/1973 Race ..... B65F 1/06 220/495.11
3,887,953 A * 6/1975 Eisenhauer ..... B63C 9/04 244/137.2
3,921,239 A * 11/1975 Sovia ..... B62B 15/00 280/18
4,054,223 A * 10/1977 Marques ..... B65D 77/061 217/43 A
4,589,365 A * 5/1986 Masters ..... B63B 34/21 114/352
4,717,362 A * 1/1988 Kraft ..... B63C 9/02 280/18
(Continued)

FOREIGN PATENT DOCUMENTS

GB 2114066 A 8/1984
JP H07-22899 * 4/1995 ..... B63B 35/73
JP H07-22899 * 4/1999 ..... B63B 35/73

*Primary Examiner* — John E Simms, Jr.
(74) *Attorney, Agent, or Firm* — Invention To Patent Services; Alex Hobson

(57) ABSTRACT

A water game apparatus having a buoyant seat platform with seats on opposing ends and handles on opposing sides to enables game participants to sit on the two opposing seats while other game participants jostle and rock the seat platform by holding onto and moving the handles. The game players try to maintain their balance and remain on the buoyant seat platform while being bucked and jostled. The last game player to remain on the buoyant seat platform is the winner. The seats may be concave depressions in the buoyant seat platform to provide some support of the game players and to prevent them from simply siding off the platform. The handles may be embedded in the seat platform of configured in a channel formed by a seat portion and water portion of an assembly. The water contact surface may be convex in shape from side to side.

8 Claims, 6 Drawing Sheets

(56) References Cited

U.S. PATENT DOCUMENTS

| | | | | |
|---|---|---|---|---|
| 5,334,066 | A * | 8/1994 | Gerard | A63G 11/00 441/130 |
| 5,421,757 | A * | 6/1995 | Basiliere | B63C 9/04 441/39 |
| 6,461,204 | B1 * | 10/2002 | Takura | B63C 11/46 440/6 |
| 7,648,449 | B1 * | 1/2010 | Detert | A63B 6/00 482/111 |
| 8,328,592 | B2 | 12/2012 | Cynamon | |
| 9,238,502 | B2 * | 1/2016 | Shackcloth | B63C 9/08 |
| 2002/0101087 | A1 * | 8/2002 | Thielking | A45F 5/102 294/143 |
| 2003/0127812 | A1 * | 7/2003 | Mehrmann | B62B 15/00 280/18 |
| 2006/0252318 | A1 * | 11/2006 | Krantz | B63C 11/49 441/35 |
| 2008/0146102 | A1 * | 6/2008 | Cheung | B29C 43/146 441/74 |
| 2011/0086562 | A1 * | 4/2011 | Checkley | B63B 34/54 441/74 |
| 2012/0017796 | A1 * | 1/2012 | Levesque | B63B 17/00 441/35 |
| 2015/0059638 | A1 * | 3/2015 | Bishop | B63B 32/57 114/363 |
| 2015/0217675 | A1 * | 8/2015 | Dayan | A63C 5/03 362/544 |
| 2020/0079481 | A1 | 3/2020 | Rice | |
| 2022/0089256 | A1 * | 3/2022 | Cannon | B63B 32/40 |

* cited by examiner

WATER GAME APPARATUS

CROSS REFERENCE TO RELATED APPLICATIONS

This application claims the benefit of priority to U.S. provisional application No. 63/296,108, filed on Jan. 3, 2022, the entirety of which is hereby incorporated by reference herein.

BACKGROUND OF THE INVENTION

Field of the Invention

The invention relates to a water game apparatus configured to float with two game players thereon and wherein the game apparatus is jostled to knock the game players of the water game apparatus.

Background

People enjoy spending time in the water playing with friends and family. There exists a need for games that are safe and fun for two or more people.

SUMMARY OF THE INVENTION

The invention is directed to a water game apparatus having a buoyant seat platform with two player seats and two handles. The buoyant seat platform has a player surface on which a pair of game players sit on opposing ends in the player seats. One or more additional game participants can then jostle the seat platform by grabbing on the handles and pushing the sides of the buoyant seat platform up and down into the water. The game players try to maintain their balance and remain on the buoyant seat platform while being bucked and jostled. The last game player to remain on the buoyant seat platform is the winner.

The buoyant seat platform may be generally rectangular in shape having a pair of parallel sides and a pair of parallel ends. The corners of the buoyant seat platform may be rounded for safety and comfort. The buoyant seat platform may have a length that is greater than a width, such as being about 1.25 times or more the width, about 1.5 times or more the width, about 2.0 times or more the width or event 3 times or more the width and any range between and including the length to width ratios provided. The buoyant seat platform has a length that extends along a centerline axis from a first end to a second end. The length may be about 1 m or more, about 1.25 m or more, about 2 m or more and any range between and including the length values provided. A shorter length requires less force for the water game apparatus to be jostled, whereas a longer length provides a greater space for larger players. The buoyant seat platform has a width that extends along a midline axis from a first side to a second side. The midline axis is perpendicular to the centerline axis. The width may be about 0.5 m or more, about 0.75 m or more, about 1 m or more, about 1 m or less, or about 0.75 m or less, or even 0.5 m or less and any range between and including the width values provided. A shorter width requires less force for the water game apparatus to be jostled. A wider width may be more stable and a more narrow width may be less stable and easier to rock back and forth. Any combination of length and width measurement may be utilized for the buoyant seat platform to achieve the desired functionality. The buoyant seat platform also has a water surface opposite the player surface. The water surface may contact a body of water when the water game apparatus is configured within a body of water.

The player surface may have a first seat configured proximal to the first end and a second seat configured proximal to the second end. The first seat and second seat may be configured on opposite sides of the midline axis from each. The first seat may have a first seat depression and the second seat may have a second seat depression in the player surface. The first and second seat depressions may be recessed a depth from the player surface and may be recessed about the same depth from the player surface or from the seat portion seat surface. The seat depressions may be concave in shape. A depth of the seat platform depressions may be about 10 mm or more, about 20 mm or more, about 30 mm or more, about 40 mm or more, about 50 mm or more and any range between and including the seat depths provided. A shallower depth provides a more difficult surface on which to maintain balance, while a deeper depth provides an easier surface on which to maintain balance. The seat depression is important to prevent the game players from simply sliding off the player surface. The specific depths of the first seat depression and second seat depression used in various embodiments of the invention may be chosen depending on the desired difficulty of balancing on the player surface. The first and second seat depressions may a have rounded or a curved perimeter portion for comfort and may be shaped to receive a person's buttocks with two separate concave depressions with ridge therebetween.

The player surface of the buoyant seat platform may be planar except for the curved perimeter edges to prevent injury as a game player falls off of the player surface, and except for the first and second seat depressions. Each of the first and second seats, or seat depressions, may extend a continuous portion of the width of the player surface or the buoyant seat platform, such as at least 30% or more, about 50% or more, about 70% or more, and any range between and including the percentages provided. Each of the first and second seats, or the seat depressions, may extend a continuous portion of the length of the player surface or the buoyant seat platform, such as at least 10% or more, about 15% or more, about 25% or more, about 35% or more and any range between and including the percentages provided. The seat depression may be a continuous depression over the width and length of the buoyant seat platform, wherein the depression extends over this percentage of width and/or length of the buoyant seat platform.

The water surface of the buoyant seat platform may be a curved surface that may be a convex curved surface along a cross-section taken along the midline, or from the first side to the second side. The water surface of the buoyant seat platform may also be curved from the first end to the second end and may also be a convex curved surface along the length of the buoyant seat platform or along a cross-section taken along the centerline of the buoyant seat platform The convex curve may be formed by one or more surfaces having a radius of curvature that are joined tangentially. The water surface of the buoyant seat platform may be bowled shaped with a convex surface extending both across the width and along the length. This bowl shape may make the buoyant seat platform less stable in the water and may make it easier to rock and jostle the game apparatus in the water. The depth of the curved convex water surface from the first side to the second side, or depth produced by the curved surface may be about 20 mm or more, about 30 mm or more, about 50 mm or more, about 75 mm or more and any range between and including the depth values provided.

The two handles are configured on opposing sides of the buoyant seat platform, with a first-side handle configured on the first side of the buoyant seat platform and a second-side handle configured on the second side of the buoyant seat platform. The first-side handle and the second-side handle are configured on opposite sides of the centerline axis from each other. The first-side handle may be a single unit or integral handle having a first-side first-end handle segment and a first-side second-end handle segment. A single unit as used herein is a one-piece component or a monolithic component. The first-side first-end handle segment may be configured proximal to the first end, and the first-side second-end handle segment may be configured proximal to the second end. The first-side first-end handle segment and the first-side second-end handle segment may be configured on opposite sides of the midline axis to each other. A first side handle support may be configured between the first-side first-end handle segment and the first-side second-end handle segment. A handle with two segments may be easier for a game player to hold in their two hands for jostling the water game apparatus.

The second-side handle may also be a single unit having a second-side first-end handle segment and a second-side second-end handle segment. The second-side first-end handle segment may be configured proximal to the first end, and the second-side second-end handle segment may be configured proximal to the second end. The second-side first-end handle segment and the second-side second-end handle segment may be configured on opposite sides of the midline axis to each other. A second side handle support may be configured between the second-side first-end handle segment and the second-side second-end handle segment.

The first-side first-end handle segment, first-side second-end handle segment, second-side first-end handle segment, and second-side second-end handle segment may be configured within handle recesses of the buoyant seat platform. Said handle recesses extend in toward the centerline axis, as recessed portions of each the first side and second side of the buoyant seat platform. These recesses may be important to prevent game players from hitting the handles as they are jostled off the water game apparatus. The handles may be recessed back from the outermost extension of the side of the buoyant seat platform including the handle support that extends between the two recessed areas. The handles may be a separate material than the buoyant seat platform, wherein the buoyant seat platform may be made of foam and the handles may be made of solid plastic, such as a hollow plastic tube or out of metal for durability.

The buoyant seat platform may consist essentially of foam, meaning that the buoyant seat platform is at least 90% foam by volume. The foam used to construct the buoyant seat platform may be any type of buoyant foam, including, but not limited, to polyurethane foam, polyethylene foam, and polystyrene foam.

The buoyant seat platform may be surrounded by a cover. The cover may also be made of foam. The cover may encompass all parts of the water game apparatus handle segments. A cover may also only extend over the player surface of the buoyant seat platform, or over the entire buoyant seat platform. The cover may be dimensioned appropriately to fit over the buoyant seat platform. The cover may have a length at least as long as the length of the buoyant seat platform, and a width at least as wide as the width of the buoyant seat platform. When the cover is implemented over the buoyant seat platform, the cover may form the player surface, water surface, first end, second end, first side, and second side. The cover may be permanently affixed over the buoyant seat platform. Alternatively, the cover may be removable from the buoyant seat platform. The cover may be a material that is either slippery, such that game players more readily slide on the cover material, or may be a material that has a higher coefficient of friction, such as a rubber or an elastomeric material, that may prevent the game players from sliding.

The buoyant seat platform may be formed as a monolithic unit by injection molding. Alternatively, the buoyant seat platform may be formed as by a water game apparatus assembly with a seat portion and a water portion. The seat portion and water portion may each be formed by injection molding. These two portions may then be joined, coupled or attached to form the water game apparatus. The handles may be configured between these two portions and retained between them when the seat portion and water portion are coupled together.

In the embodiments in which the buoyant seat platform is formed as water game apparatus assembly, the seat portion may have a seat portion seat surface and a seat portion mating surface. The seat portion seat surface may be the player surface of the buoyant seat platform. The seat portion mating surface may have a first-side channel and a second-side channel extending along the length of the seat portion and configured proximal to the first side and proximal to the second side of the buoyant seat platform. These channels are the second side of the seat portion mating surface, and configured to receive and retain a portion of the first-side handle and second-side handle, respectively.

The water portion may have a water portion water surface and a water portion mating surface. The water portion water surface may act as the water surface of the buoyant seat platform. As with the seat portion mating surface, the water portion mating surface may have a water portion first-side channel and second-side channel configured along the first side and second side of the water portion.

In the water game apparatus assembly, the buoyant seat platform may be formed by attaching the seat portion mating surface with the water portion mating surface, such as by gluing, fastening, and the like. The attachment may be a permanently attachment, such as gluing or welding, wherein the seat portion cannot be removed from the water portion without damage, such as by cutting or breaking the connection or attachment. The seat portion first-side channel and the water portion first-side channel may align to form a first full channel in which the first-side handle is retained. The seat portion second-side channel and the water portion second-side channel may align to form a second full channel in which the second-side handle is retained. A portion of the first-side handle may be completely encased within the first full channel on the ends and optionally along a portion of the handle between the first end and second end of the first-side handle. The exposed portions of the first-side handle may form the first-side first-end handle segment and the first-side second end handle segment, which may be exposed via the handle recessions. A portion of the second-side handle may be completely encased within the second full channel on the end and optionally along a portion of the handle between the first end and the second end of the second-side handle. The exposed portions of the second-side handle may form the second-side first-end handle segment and the second-side second end handle segment, which may be exposed via the handle recessions.

The invention further is directed to a method of playing a water game utilizing the water game apparatus described herein. Said water game may be played by a pair of game players, a first sitting player and aa second sitting player, and a first game participant, a game rocking player. The game may be played with a second rocking player. The first and second rocking players may be configured on opposing sides of the buoyant seat platform. The water game apparatus is placed in a body of water in order to play the water game.

The first sitting player may sit on the first seat and the second sitting player may sit on the second seat. The first sitting player and second sitting player may face each other when sitting on the first seat and second seat, respectively. The first rocking player may hold the first-side handle and the second rocking player may hold the second-side handle. The first rocking player and the second rocking player may face each other when holding the first-side handle and second-side handle. The first rocking player and second rocking player may be within a body of water when holding the handles and may rock or jostle the buoyant seat platform to dislodge the first and/or second game player from the seat platforms. The buoyant seat platform may be jostled by the first rocking player and second rocking player alternatively pushing the handles down in the water to cause the buoyant seat platform to rock or rotate about the centerline of the buoyant seat platform. Also, the first rocking player and second rocking player may push down on the handles to cause the buoyant seat platform to rock or rotate about the midline of the buoyant seat platform. A combination of both rocking methods may be used.

The first rocking player may rock the water game apparatus by holding the first-side handle. The second rocking player may also rock the water game apparatus by holding the second-side handle. Either rocking player may rock the water game apparatus by pushing down on the handle that they hold. The first rocking player may rock the water game apparatus by pushing down on the first-side first-end handle segment followed by pushing down on the first-side second-end handle segment to rock the water game apparatus about the midline axis. The second rocking player may rock the water game apparatus by pushing down on the second-side first-end handle segment followed by pushing down on the second-side second-end handle segment to rock the water game apparatus about the midline axis.

The first rocking player and the second rocking player may alternate rocking the water game apparatus. The water game apparatus may make a series of partial rotations about the centerline axis when either rocking player rocks the water game apparatus. The water game apparatus may alternatively make a series of partial rotations about the midline axis when either rocking player rocks the water game apparatus. Alternatively, the water game apparatus may make a series of partial rotations about the centerline axis and about the midline axis when either rocking player rocks the water game apparatus. The water game apparatus may further translate across the body of water when either rocking player rocks the water game apparatus.

When either rocking player rocks the water game apparatus, the first sitting player and second sitting player may lose their balance and fall off of the player surface and into the body of water. The first sitting player that falls off of the player surface before the other sitting player is considered the loser, and the sitting player that remains on the player surface when the other sitting player has fallen off the player surface is considered the winner.

The body of water in which the water game apparatus is placed may be a pool, or a natural body of water, such as a lake, river, bay, ocean and the like. The body of water may be effectively deep wherein the game players will not hit the bottom of the body of water when jostled off the seat platform. The body or water may be about 1 m deep or more, about 1.5 m deep or more, about 2 m deep or more, about 3 m deep or more. The depth of the body of water may be greater than a height of either of the rocking players and the handles may provide support for the rocking players during game play.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
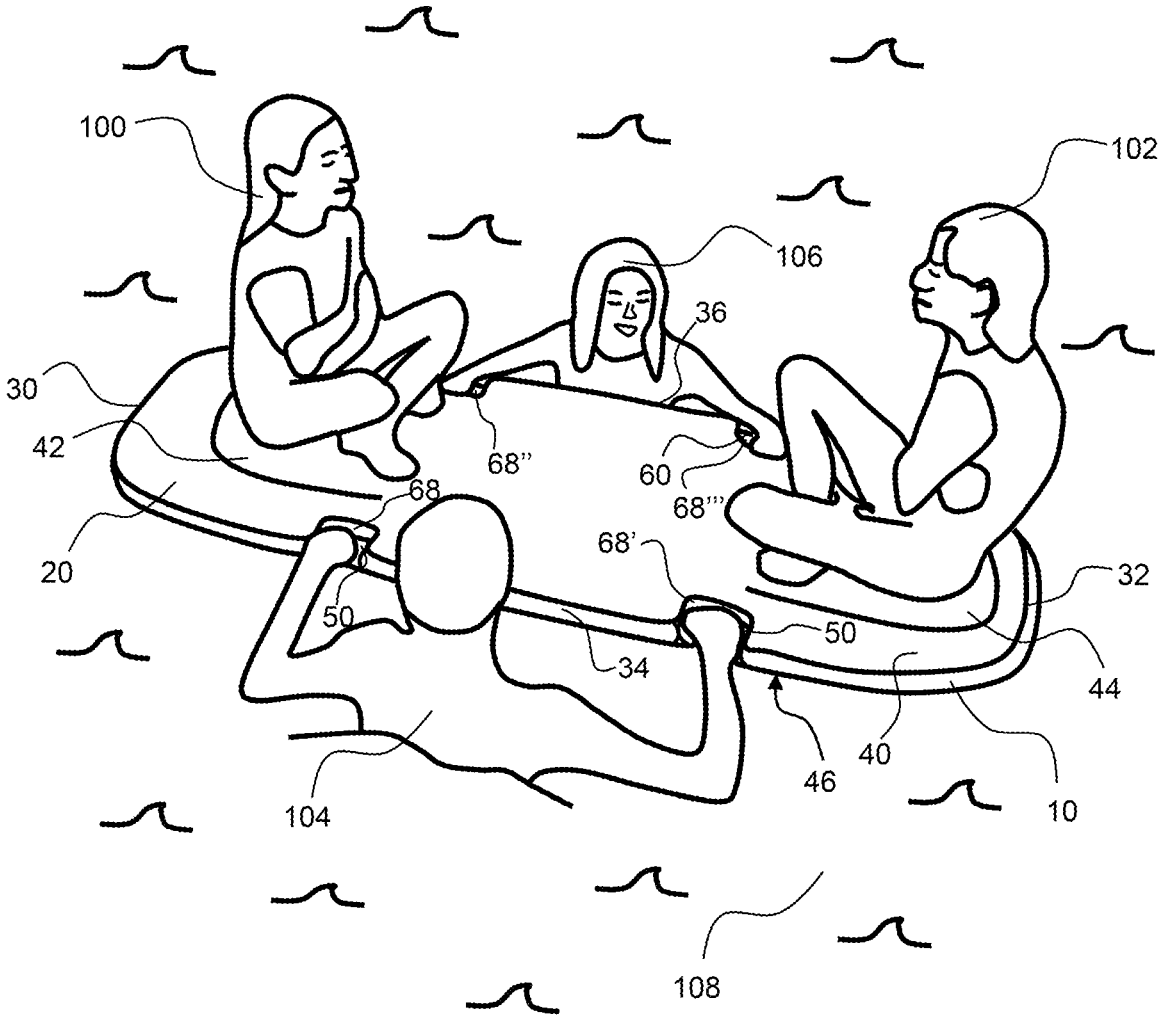
FIG. 1 shows a perspective view of a water game apparatus in a body of water with a first sitting player, a second sitting player, a first rocking player, and a second rocking player.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, a water game apparatus 10 includes of a buoyant seat platform 20, a first-side handle 50, and a second-side handle 60. The buoyant seat platform 20 has a first end 30 opposite a second end 32, and a first side 34 opposite a second side 36. The buoyant seat platform further has a player surface 40 on which are located a first seat 42 and a second seat 44. Opposite the seat platform 40 is a water surface 46 which contacts a body of water 108 in which the water game apparatus 10 is implemented.

The first-side handle 50 is configured on the first side 34 of the buoyant seat platform 20, and the second-side handle 60 is configured on the second side 36 of the buoyant seat platform 20. Portions of both the first-side handle 50 and the second-side handle 60 are configured within handle recesses 68, 68', 68", and 68' Handle recesses 68 and 68' are configured on the first side 34, and handle recesses 68" and 68" are configured on the second side 36.

The first-side handle 50 is held by a first rocking player 104, who is in the body of water 108 near the first side 34 of the water game apparatus 36. The second-side handle 60 is held by a second rocking player 106, who is in the body of water 108 near the second side 36 of the water game apparatus 10. A first sitting player 100 is seated in the first seat 42 on the player surface 40. A second sitting player 102 is seated in the second seat 44 on the player surface 40. The first rocking player 104 and the second rocking player 106 are facing each other when holding the first-side handle 50 and second-side handle 60, respectively. The first sitting player 100 and the second sitting player 102 are facing each other when seated in the first seat 42 and second seat 44, respectively.

Figure 2:
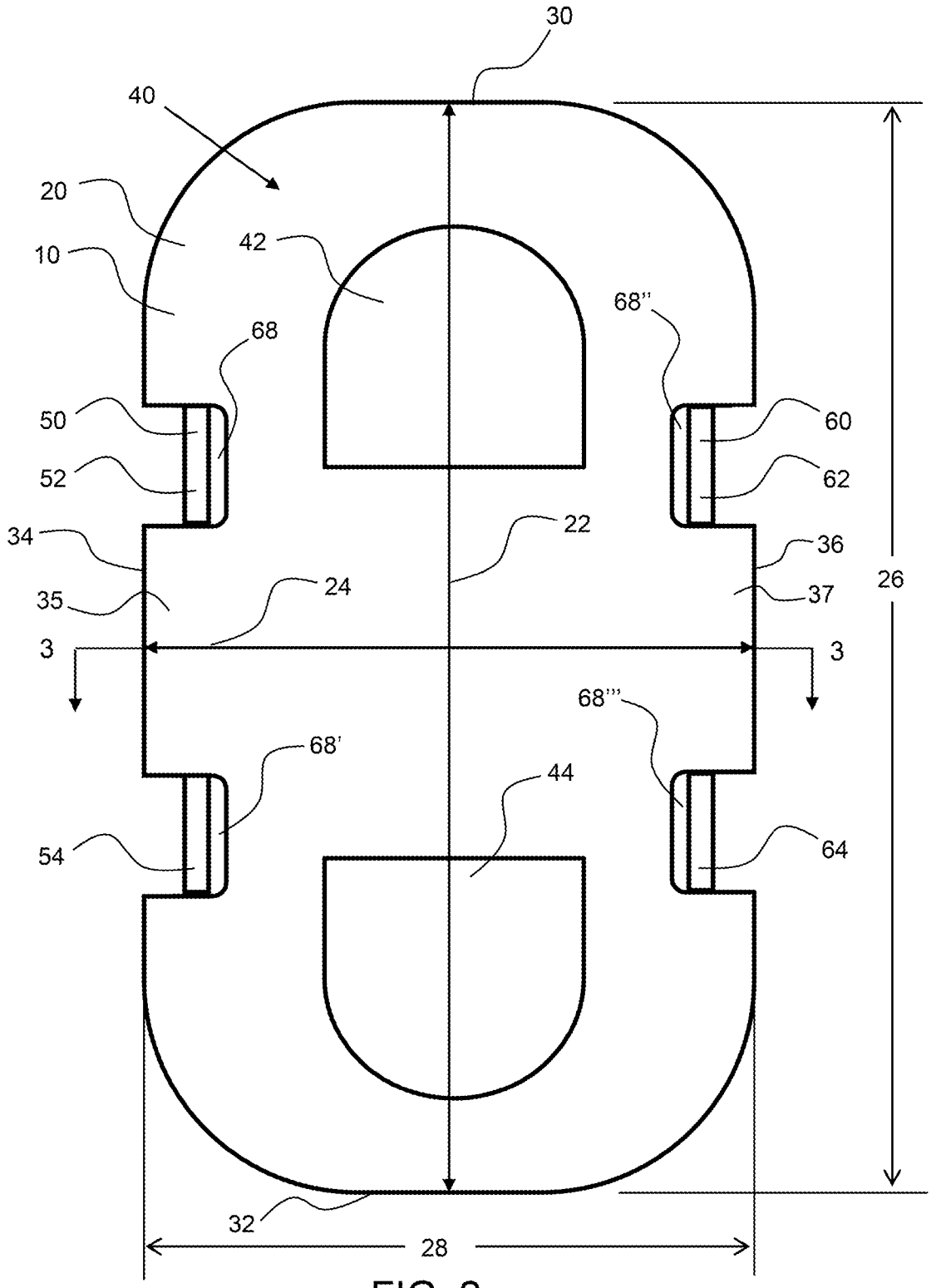
FIG. 2 shows a top view of a water game apparatus and defines the view of FIG. 3 by the line 3-3.

As shown in FIG. 2, the first end 30 and second end 32 of the buoyant seat platform 20 are separated by a length 26. A centerline axis 22 spans the length 26 between the first end 30 and second end 32. The first side 34 and second side 36 of the buoyant seat platform are separated by a width 28. A midline axis 24 spans the width 28 between the first side 34 and second side 36. The midline axis 24 is perpendicular to the centerline axis 22. The first seat 42 and the second seat 44 are configured on the player surface 40, and are on opposite sides of the midline axis 24. The first seat 42 is near the first end 30, and the second seat 44 is near the second end 32. The first-side handle 50 and second-side handle 60 extend parallel with the centerline axis 22, or put another way, extend in alignment with the centerline axis direction.

The first-side handle 50 has a first-side first-end handle segment 52 and a first-side second-end handle segment 54. The first-side first-end handle segment 52 is configured within a handle recess 68, and is configured on the first side 34 near the first end 30. The first-side second-end handle segment 54 is configured within a handle recess 68', and is configured on the first side 34 near the second end 32.

The second-side handle 60 has a second-side first-end handle segment 62 and a second-side second-end handle segment 64. The second-side first-end handle segment 62 is configured within a handle recess 68", and is configured on the second side 36 near the first end 30. The second-side second-end handle segment 64 is configured within a handle recess 68'", and is configured on the second side 36 near the second end 32.

The first-side first-end handle segment 52 and the first-side second-end handle segment 54 are on opposite sides of the midline axis 24 from one another. The second-side first-end 62 handle segment and the second-side second-end handle segment 64 are on opposite sides of the midline axis 24 from one another. The first-side first-end handle segment 52 and the second-side first-end handle segment 62 are on opposite sides of the centerline axis 22 from one another. The first-side second-end handle segment 54 and the second-side second-end handle segment 64 are on opposite sides of the centerline axis 22 from one another.

Figure 3:
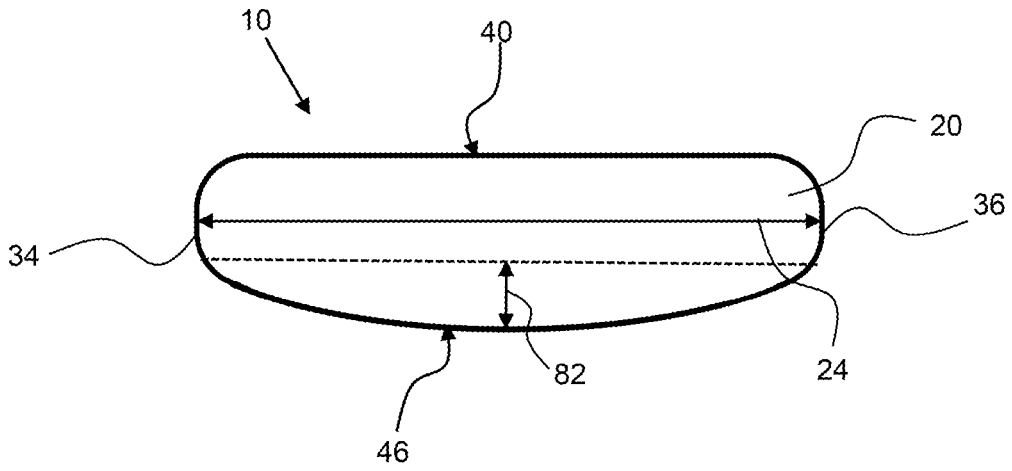
FIG. 3 shows the front cross-section view of the water game apparatus defined by line 3-3 of FIG. 2.

As shown in FIG. 3, the water surface 46 of the buoyant seat platform 20 is opposite the player surface 40 of the buoyant seat platform 20. The water surface 46 is a curved surface and is a convex surface having depth 82 and extending from the first side 34 to the second side 36.

Figure 4:
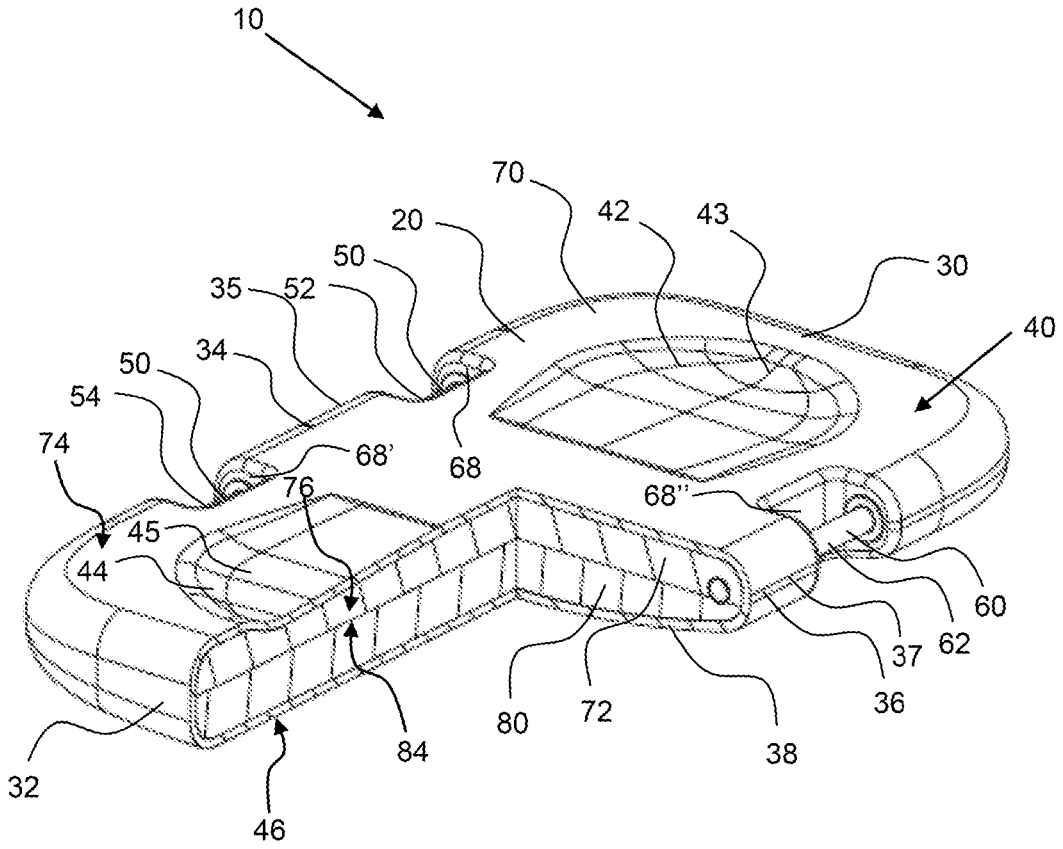
FIG. 4 shows a perspective view of a water game apparatus with a cutaway section showing the interior of the water game apparatus.

As shown in FIG. 4, the water game apparatus 10 is a water game apparatus assembly 70 having a buoyant seat platform 20 that is constructed from a seat portion 72 and a water portion 80. The seat portion has a seat portion seat surface 74, which is the same surface as the player surface 40 of the buoyant seat platform 20. The water portion has a water portion water surface 46, which is the same surface as the water surface 46 of the buoyant seat platform 20.

The seat portion 72 has a seat portion mating surface 76 opposite the seat portion seat surface 74. The water portion 80 has a water portion mating surface 84 opposite the water portion water surface 46. The seat portion mating surface 76 and the water portion mating surface 84 mate to form the buoyant seat platform 20. The first-side handle 50 and the second-side handle 60 are configured between the seat portion 72 and water portion 80 within a first full channel and a second full channel (not shown in FIG. 4), respectively.

Also as shown in FIG. 4, a cover 38 may be implemented around the buoyant seat platform 20. The cover 38 may extend over and/or encapsulate the buoyant seat platform 20, and/or may extend over the player surface 40, water surface 46, first end 30, second end 32, first side 34, and second side 36. The first-side first-end handle segment 52, first-side second-end handle segment 54, second-side first-end handle segment 62, and second-side second-end handle segment 64 are exposed from the cover 38.

Also as shown in FIG. 4, the first seat 42 comprises a first seat depression 43 that is a recess in the player surface 40. The second seat 44 comprises a second seat depression 45 that is a recess in the player surface 40. The recess may extend down a recess depth from the otherwise planar player surface 40 of the buoyant seat platform 20.

Figure 5:
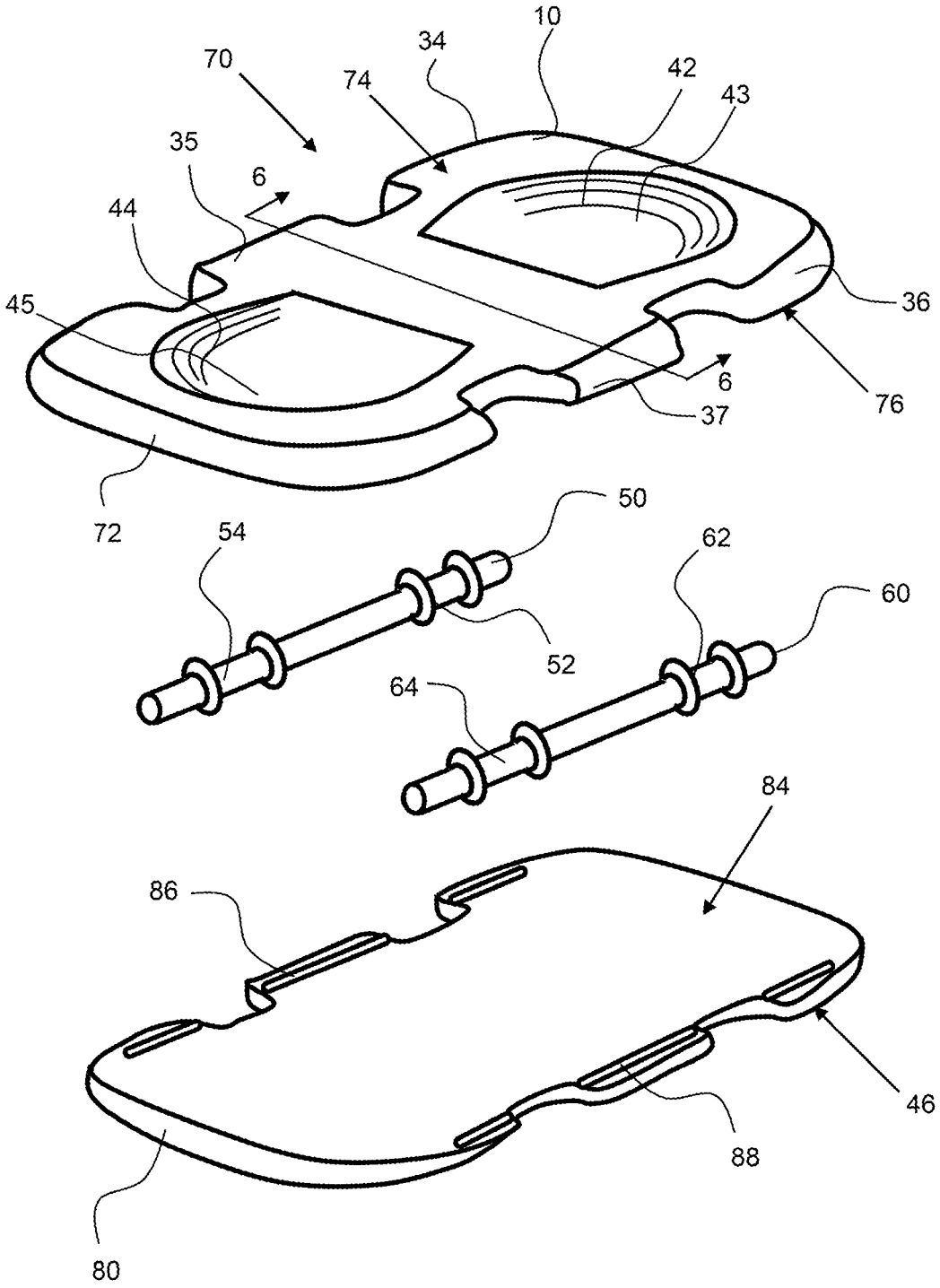
FIG. 5 shows an exploded view of a seat portion, a water portion, a first-side handle, and a second-side handle of a water game apparatus.
Figure 6:
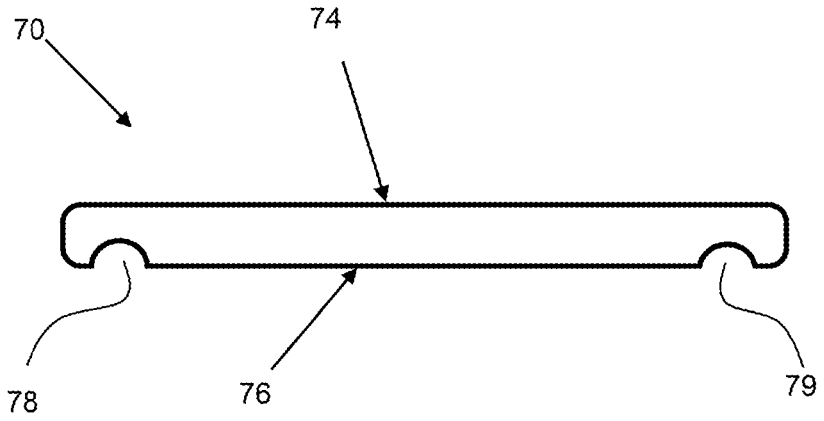
FIG. 6 shows a cross-sectional view of the seat portion taken along line 6-6 in FIG. 5 and shows the seat portion first channel and seat portion second channel.

Referring now to FIGS. 5 and 6, a water game apparatus assembly 70 of a water game apparatus 10 has a seat portion 72 and a water portion 80 that are coupled together around the first-side handle 50 and the second-side handle 60. The seat portion 72 has a seat portion seat surface 74 and a seat portion mating surface 76 opposite the seat portion seat surface 74. The water portion 80 has a water portion water surface 46 and a water portion mating surface 84. The water portion mating surface 84 may mate with the seat portion seat mating surface 76 when the water game apparatus assembly 70 is assembled. A water portion first channel 86 and a water portion second channel 88 are configured on opposite sides of the water portion mating surface 84. The seat portion 72 also has a seat portion first channel 78 and a seat portion second channel 79 configured on the seat portion mating surface 76, as shown in FIG. 6. When the water game apparatus assembly 70 is assembled, the seat portion first channel 78 and water portion first channel 86 align to form a first channel that is configured around and retains the first-side handle 50. Likewise, the seat portion second channel 79 and the water portion second channel 88 align to form a second channel that is configured around and retains the second-side handle 60. A first-side handle support 35 extends around the single monolithic first-side handle 50 to provide additional support of the handle and to also produce the first-side first-end handle segment 52 and first-side second-end handle segment 54. Likewise, a second-side handle support 37 extends around the single monolithic second-side handle 60 to provide additional support of the handle and to also produce the second-side first-end handle segment 62 and second-side second-end handle segment 64. The first-side handle 50 and a second-side handle 60 may have collars configured to extend over the channels produced by the assembly of the seat portion 70 and water portion 80. The first-side handle 50 has a first-side first-end handle segment 52 and a first-side second-end handle segment 54. The second-side handle has a second-side first-end handle segment 62 and a second-side first-end handle segment 64.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A water game apparatus consisting of:

a) a buoyant seat platform comprising:

i) a length extending along a centerline axis from a first end to a second end;

ii) a width extending along a midline axis from a first side to a second side;

iii) a player surface extending from said first end to said second end and from the first side to the second side and having a first seat configured proximal to said first end and a second seat configured proximal to the second end; wherein each of the first seat and second seat-consists of a seat depression in the player surface having a seat depression depth of between 10 mm and 50 mm; and wherein the first seat and the second seat are configured for a first player sitting in said first seat to face a second player sitting in said second seat by the seat depression of each the first seat and the second seat being deeper proximal to the respective first end and second end of the buoyant seat platform than said midline;

wherein the player surface is planar except for the first seat depression of the first seat and the second seat depression of the second seat;

iv) a water surface opposing said player surface and having a convex surface;

b) a first-side handle configured along the first side; and c) a second-side handle configured along the second side;

d) a first side handle support; and e) a second side handle support;

wherein the first-side handle is a monolithic handle and comprises a first-side first-end handle segment extending from a first end of the first side handle support and a first-side second-end handle segment extending from a second end of the first side handle support;

wherein the second-side handle is a monolithic handle and comprises a second-side-first-end handle segment extending from a first end of the second side handle support and a second-side-second-end handle segment extending from a second end of the second side handle support;

wherein the first-side first-end handle segment and the first-side second-end handle segment extend across handle recesses of the buoyant seat platform that extend in toward the centerline axis on opposing sides of the first side handle support, wherein the first side handle extends between the player surface and the water surface of the buoyant seat platform; and wherein the second-side first-end handle segment and the second-side second-end handle segment extend across handle recesses of the buoyant seat platform that extend in toward the centerline axis on opposing sides of the second side handle support, wherein the second side handle extends between the player surface and the water surface of the buoyant seat platform.

2. The water game apparatus of claim 1, wherein the convex surface of the water surface extends a depth of at least 30 mm from the first side and the second side.

3. The water game apparatus of claim 1, wherein the first-side handle extends through the first side handle support, and wherein the second-side handle extends through the second side handle support.

4. The water game apparatus of claim 3, wherein the seat depression of the first seat and second seat each have a depression depth of at least 20 mm.

5. The water game apparatus of claim 1, wherein seat depression of the first seat and second seat each have a depression depth of at least 20 mm.

6. The water game apparatus of claim 5, wherein the buoyant seat platform is made of foam.

7. The water game apparatus of claim 1, wherein the buoyant seat platform is made of foam.

8. The water game apparatus of claim 7, wherein the buoyant seat platform consists essentially of foam.

* * * * *